US007984699B2

(12) United States Patent
Theorell

(10) Patent No.: US 7,984,699 B2
(45) Date of Patent: Jul. 26, 2011

(54) COOLING SYSTEM

(75) Inventor: Gunnar Theorell, Lerum (SE)

(73) Assignee: Volvo Lastvagnar AB, Göteborg (SE)

( * ) Notice: Subject to any disclaimer, the term of this patent is extended or adjusted under 35 U.S.C. 154(b) by 255 days.

(21) Appl. No.: 12/305,398

(22) PCT Filed: Jul. 20, 2006

(86) PCT No.: PCT/SE2006/000901

§ 371 (c)(1),
(2), (4) Date: Dec. 18, 2008

(87) PCT Pub. No.: WO2008/010749

PCT Pub. Date: Jan. 24, 2008

(65) Prior Publication Data

US 2009/0277401 A1 Nov. 12, 2009

(51) Int. Cl.
*F01P 9/00* (2006.01)

(52) U.S. Cl. ..... 123/41.01

(58) Field of Classification Search ..... 123/184.21–184.61, 447, 452, 123/461, 514

See application file for complete search history.

(56) References Cited

U.S. PATENT DOCUMENTS 2,724,246 A * 11/1955 Lowe ..... 62/119
3,499,481 A * 3/1970 Avrea ..... 165/11.1
3,989,103 A * 11/1976 Cieszko et al. ..... 165/110
4,346,757 A * 8/1982 Cheong et al. ..... 165/51

FOREIGN PATENT DOCUMENTS

GB 588284 A 5/1947
WO 2005040574 A1 5/2005

OTHER PUBLICATIONS

International Search Report for corresponding International Application PCT/SE2006/000901.

* cited by examiner

*Primary Examiner* — Michael Cuff
*Assistant Examiner* — Keith Coleman
(74) *Attorney, Agent, or Firm* — WRB-IP LLP

(57) ABSTRACT

A cooling system for an engine is divided into an inner circuit and an outer circuit, said inner circuit including a radiator, a cooling pump, a thermostat housing, an ejector pump, cooling channels arranged inside the engine and ducting connecting said components. The ejector pump is arranged to draw coolant from the outer system and deliver it to the inner system. The outer system includes an expansion tank, ducting interconnecting the expansion tank and the ejector pump and ducting interconnecting the inner circuit and the expansion tank. A one-way valve is placed in the ducting interconnecting the expansion tank and the inner circuit.

18 Claims, 2 Drawing Sheets

COOLING SYSTEM

BACKGROUND AND SUMMARY

The present invention relates to a cooling system for an engine, said cooling system being divided into an inner circuit and an outer circuit. The inner circuit comprises a radiator, a cooling pump, a thermostat housing, an ejector pump and cooling channels arranged inside the engine. The ejector pump is arranged to draw coolant from the outer system, which comprises an expansion tank, ducting interconnecting the expansion tank and the ejector pump and ducting interconnecting the inner circuit and the expansion tank and deliver it to the inner system.

Moreover, the present invention relates to an ejector pump for pressurizing a cooling system of a combustion engine.

As is well known by persons skilled in the art, the main purpose of a cooling system of an engine is to transfer heat generated in the engine to a radiator, where the heat could be vented to the ambient air. In its simplest form, a cooling system could comprise area-increasing metal fins arranged e.g. on cylinder walls of the engine to be cooled. This type of cooling is generally referred to as air-cooling, and was the first cooling system used on internal combustion engines.

On modern, high performance engines, air-cooling is not sufficient to cool the engine; instead, a cooling system with a coolant is arranged. The coolant is usually water mixed with anti-freezing and anti-corrosion agents and the ducting is arranged to move the coolant from cooling channels in the engine (where the coolant absorbs heat from the engine, hence cooling it) to a radiator, where the absorbed heat is vented to the ambient air. This type of cooling is generally referred to as water-cooling, and is much more efficient than air cooling.

In order to ensure a cooling that is not too great, and not too small, there is usually provided a thermostat in the coolant ducting. The purpose of the thermostat is to redirect coolant to bypass the radiator if the coolant should be cooler than desired.

There are however some problems to be solved relating to water cooling: Firstly, there is a trend towards higher coolant temperatures; a high coolant temperature gives a higher maximum cooling rate (due to a larger temperature difference between the coolant and the ambient air) and also less heat transfer from the engine's combustion chambers to the coolant, which is beneficial for engine efficiency. The higher temperatures lead to higher stress levels on cooling system components made of plastic materials or rubber. Especially the expansion chamber (a component well known by persons skilled in the art) is a component that gets significantly more expensive if it should stand elevated coolant temperatures.

Secondly, water-cooling systems have problems with cavitation; cavitation means that a liquid is forced to boil by decompression, which gives gas bubbles in the liquid; these gas bubbles have, however, a very short life; as soon as the pressure in the liquid returns to normal levels, the bubbles will implode to liquid. Cavitation is detrimental to cooling system components due to the "micro-shocks" resulting from the bubble implosions, and is rather common in cooling systems. The results of cavitation, e.g. small "holes" in metal components constituting the cooling system, could be seen e.g. on pumping fins.

Thirdly, water-cooling systems have problems with boiling after engine shut-off; after the engine has been shut off, the coolant will stop circulating in the cooling system. Remaining heat from e.g. the cylinder walls and the exhaust manifold will be transferred to the coolant, which might reach boiling temperature. As is well known by persons skilled in the art, the volume of gas exceeds the volume of the liquid it emanates from, under normal atmospheric conditions by a factor exceeding 100. The volume increase emanating from boiling might force coolant out from the cooling system, which leads to increased coolant consumption. Fourthly, air entrainment might (or rather, will) pose a problem if the coolant is not deaerated continuously. In prior art system, the deaeration of the coolant will take place in the expansion chamber, but as will be evident in the following, this is a solution that will not be very efficient in the future.

One efficient, known, way of reducing the problems with cavitation and boiling after engine shut-off is to increase the coolant pressure. This is however rather expensive, since the expansion tank must be a vessel standing high pressures, i.e. a vessel having thick walls.

U.S. Pat. No. 4,346,757 describes an automotive vehicle cooling system having a radiator connected to the engine coolant jacket for circulation of coolant, a pump delivering coolant from the radiator to the engine, a non-pressurized reservoir bottle, or expansion vessel, communicating with a radiator and having a make-up line communicating with a Venturi in a recirculating line around the pump directing coolant from the pump outlet to the pump inlet. The Venturi allows make-up coolant to be added from the reservoir bottle at atmospheric pressure so that the bottle can be of a relatively light-weight gauge material.

U.S. Pat. No. 4,346,757 solves, in part, the problem with cavitation by putting the cooling system under pressure; however, deaeration of the coolant takes place in the expansion vessel, which requires a constant stream of coolant from the cooling system to the expansion vessel. At low engine speed, and as the engine is shut off, there will be only a small, or no, pressure increase in the cooling system, since the pressure in the cooling system and the expansion chamber will be equalized rapidly at low engine speeds or as the engine is shut off, due to the provision of a capillary hose (34) between the radiator and the expansion vessel. Consequently, the design according to U.S. Pat. No. 4,346,757 does not in any way address the problem of boiling after engine shut-off.

U.S. Pat. No. 6,886,503 describes a cooling system wherein the internal pressure is increased by letting in compressed air from a turbocharger into the expansion vessel. Although simple and cost efficient, this solution addresses neither the problem of expensive, pressure capable expansion vessels nor coolant boiling after engine shut-off.

One problem with subjecting an expansion vessel for compressed air, is that this type of vessel will "breathe" frequently and coolant can escape from the vessel each time the inlet valve is opened.

It is desirable to provide a cooling system having an elevated pressure, which pressure remains at low engine speed and after engine shut-off.

According to an aspect of the invention, solved by the provision of a one-way valve placed in a ducting interconnecting the expansion tank and an inner cooling circuit.

In order to reach a sufficient working pressure, the one-way valve could have an opening pressure of about 0.5 bar.

If the one-way valve has an opening pressure of about 0.5 bars, a second one-way valve allowing a coolant flow from the expansion tank towards the ejector pump is preferably provided.

In order to obtain an efficient deaeration of the coolant, a deaeration tank could serve as a junction for a ducting from an elevated position in the engine cooling system, a ducting from an inlet of the coolant pump, a ducting from a top portion of the radiator, and the ducting interconnecting the inner circuit and the expansion tank.

The deaeration tank could have a volume of about 1-5 liter.

Furthermore, the ejector pump comprises an inlet chamber connected to an expansion tank, a nozzle opening in the inlet chamber and ejecting a flow of coolant towards a neck connecting the inlet chamber and a mixing zone having an increasing diameter in a flow direction of the coolant flow ejected from the nozzle. In order to get a sufficient pumping effect, the nozzle diameter could be about 2-4 mm and the neck diameter could be about 5-10 mm. The length of the mixing zone could be about 4 to 10 times the diameter of the neck, and the mixing zone 175 could have a diameter increasing from the neck diameter to about 2 to 3 times the diameter of the neck.

BRIEF DESCRIPTION OF THE DRAWINGS

In the following, the invention will be described with reference to the appended drawings, wherein.

DETAILED DESCRIPTION

Figure 1:
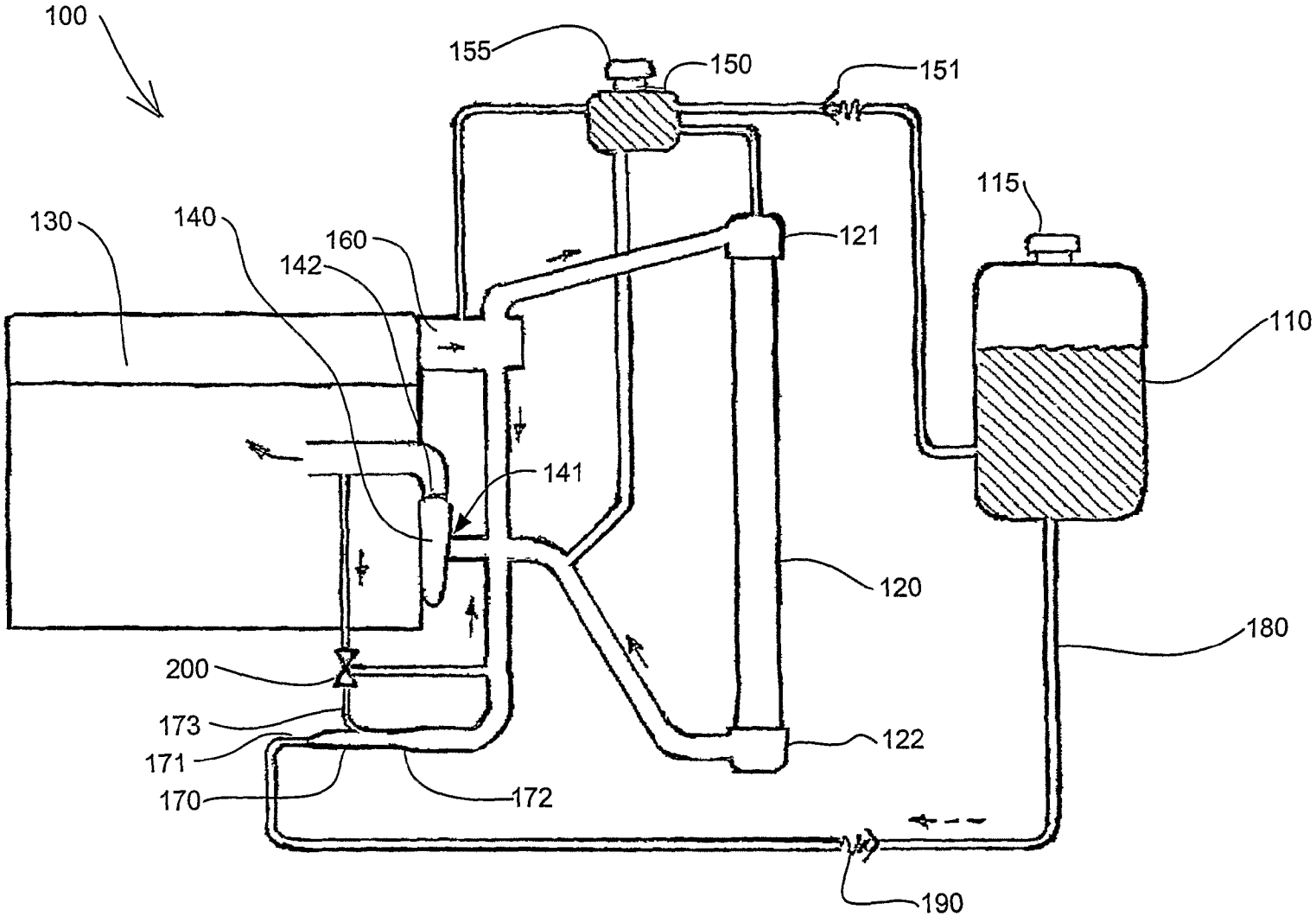
FIG. 1 is a schematic view of a cooling system according to the present invention.

In FIG. 1, a cooling system 100 according to the present invention is shown schematically. The cooling system 100 comprises an expansion tank 110, a radiator 120, a cooling system of an engine 130, a coolant pump 140, a deaeration tank 150, a thermostat housing 160 and an ejector pump 170 as well as piping, hosing or ducting connecting these components in a way that will be described below.

The expansion tank 110 is provided with a coolant outlet hose 180 connecting the expansion tank 110 to an ejector pump inlet 171 of the ejector pump 170. A one-way valve 190 in the hose 180 allows a flow of coolant from the expansion tank 110 to the ejector pump 170, but stops coolant from flowing in the opposite direction.

An ejector pump outlet 172 of the ejector pump 170 is connected to a coolant inlet 141 of the coolant pump 140. A coolant outlet 142 of the coolant pump is connected to the internal cooling system of the engine 130. Moreover, a power connection 173 of the ejector pump 170 is connected to the coolant pump outlet 142, allowing a flow of coolant from the coolant outlet 142 to the power connection of the ejector pump 170.

The coolant from the coolant pump 140 not flowing to the ejector pump 170 will pass the internal cooling system of the engine 130, collecting heat from friction and combustion, and enter an inlet of the thermostat housing 160. Depending on the coolant temperature, a thermostat (not shown) housed in the thermostat housing will direct the coolant flow either to an upper portion 121 of the radiator 120, to the coolant inlet 141, or, if the coolant temperature is within acceptable limits, to both the upper portion 121 and the coolant pump inlet 141.

A lower portion 122 of the radiator is connected to the coolant pump inlet 141.

The deaeration tank 150 is connected to an upper part of the cooling system of the engine 130, the upper portion 121 of the radiator 120, the coolant pump inlet 141 and the expansion tank 110. A one-way valve 151 is provided in the connection between the deaeration tank 150 and the expansion tank 110, the one-way valve allowing a coolant flow from the deaeration tank 150 towards the expansion tank 110. In a preferred embodiment of the invention, the one-way valve has an opening pressure of about 0.5 bar in the allowed direction.

In one specific embodiment of the invention, a pressure guard 200 will limit the flow of coolant from the pump outlet 142 through the power connection 173 if the pressure at the ejector pump outlet 172 would exceed a certain value, e.g. 0.6 bar.

As could be understood from the above, the cooling system 100 could be divided into an inner circuit, which includes the cooling channels in the engine 130, the coolant pump 140, the thermostat housing 160, the deaeration tank 150, the ejector pump outlet 172, its power connection 173, and the piping and hosing connecting such components, and an outer circuit, comprising the connection between the hosing from the deaeration tank 150 to the expansion tank 110, the expansion tank 110 itself, the ejector pump inlet 171 and hosing connecting the expansion tank 110 and the ejector pump inlet 171. During engine running, there will be a large flow of coolant in the inner circuit and a significantly lower flow of coolant in the outer circuit.

Figure 2:
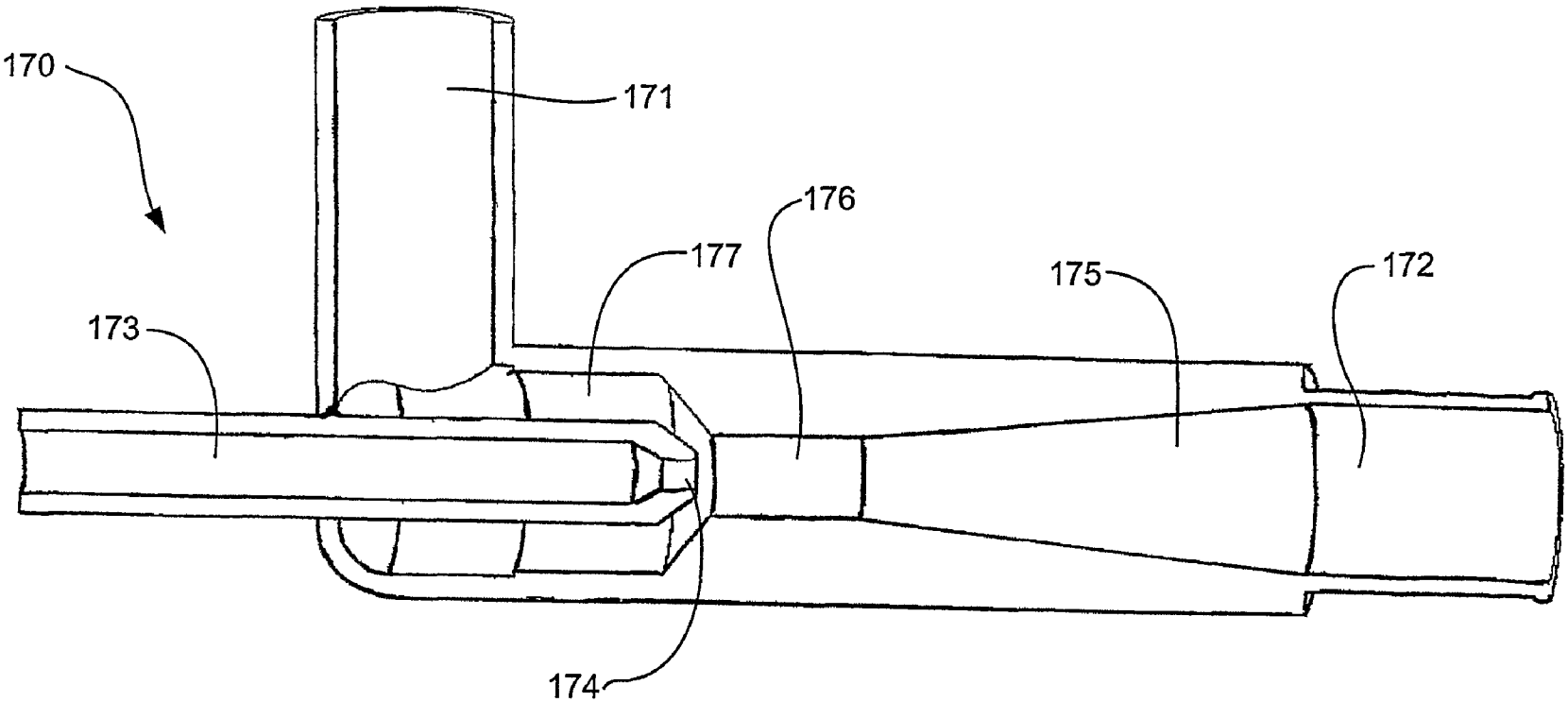
FIG. 2 is a schematic section view of an ejector pump according to the present invention.

In FIG. 2, a schematic view of the ejector pump 170 is shown. As mentioned above, the ejector pump 170 comprises the ejector pump inlet 171, the ejector pump outlet 172, and the power connection 173. Although well known by persons skilled in the art, the function of the ejector pump will be briefly explained in the following. Except for the above connections, the ejector pump 170 comprises a nozzle 174 connected to the power connection 173, a mixing zone 175 communicating with the outlet 172 and a neck 176. The nozzle 174 opens in an inlet chamber 177, which communicates with the inlet 171 and has a diameter larger than the neck 176, which connects the inlet chamber and the mixing zone. In use, a jet flow of any liquid (in this case, however, preferably coolant) is ejected from the nozzle 174 towards the neck 176. The jet flow will draw liquid from the inlet chamber 177, hence creating a pumping action for the ejector pump 170. The ratio of the diameters of the nozzle 174 and the neck 176, respectively, is crucial for the pumping characteristics of the ejector pump as a whole; if the nozzle diameter/neck diameter ratio is small, i.e. close to one, the ejector pump will obtain a large pressure capability, but a limited maximal volume pumped per time unit. The opposite is true for larger nozzle diameter/neck diameter ratios.

Hereinafter, functional matters of the cooling system 100 will be described.

At engine startup, the coolant pump 140 will be energized, either by a connection to the engine crankshaft or by an electrical connection to a power supply system. Upon energizing, the coolant pump will start pumping coolant from the coolant inlet 141 to the coolant outlet 142, which pumping will create a coolant flow though the engine 130, the thermostat housing 160, and the radiator 120, if the thermostat housed in the thermostat housing detects a too high coolant temperature. In case the coolant temperature would be lower, the thermostat will redirect at least a part of the coolant flow directly to the coolant inlet 141. As could be understood, the pumping of coolant through the coolant pump 140 will yield a pressure difference between the coolant inlet 141 and the coolant outlet 142; as stated earlier, the power connection 173 connects the coolant inlet 141 and the coolant outlet 142. Hence, a coolant flow from the coolant outlet towards the coolant inlet will result. The coolant flow will flow through the nozzle 174 of the cooling pump 141, hence drawing coolant from the inlet chamber 177, which, as can be seen in the figures, is connected to the ejector pump inlet 171. Ultimately, this will lead to coolant being drawn from the expansion tank 110 through the coolant outlet hose 180. As could be understood by persons skilled in the art, the coolant flow from the expansion tank through the ejector pump towards the coolant inlet 141 will increase the pressure in the inner circuit of the cooling system.

In order to deaerate the coolant, the deaeration tank 150 is connected to an elevated point in the coolant system of the engine 130, to the upper portion 121 of the radiator 120, to the expansion tank 110 and to the coolant inlet 141. During the energizing of the coolant pump 140, a coolant flow to the deaeration tank from the elevated point in the cooling system of the engine and the upper portion 121 of the radiator 120, respectively, and a flow from the deaeration tank to the coolant inlet 141 will result, as a result of a pressure drop over the radiator 120.

Moreover, there will be a flow of coolant (occasionally mixed with gas bubbles) from the deaeration tank 150 to the expansion tank 110, via the one-way valve 151. This flow is due to the pumping action of the ejector pump 170 from the expansion tank 110 to the coolant inlet 141, which, as mentioned, gives a higher pressure in the inner circuit of the cooling system.

As mentioned, the one-way valve 151 may have an opening pressure of about 0.5 bar; this would then be the maximal pressure in the coolant system.

After engine shutoff, the coolant in the cooling system will initially experience a heating due to heat being transferred from e.g. engine oil, cylinder walls and exhaust system. Consequently, the coolant volume will increase. Should the pressure in the cooling system increase above the opening pressure of the one-way valve 151, a flow of coolant through the one-way valve 151 to the expansion tank 110 will result. Later after engine shut-down, the coolant temperature will adapt to an ambient temperature, which usually is significantly lower than the coolant temperature of a running engine; obviously, a coolant volume decrease will result. Should the volume decrease result in a coolant pressure lower than a pressure in the expansion tank 110, coolant will be sucked in through the one-way valve 190 and the ejector pump 170.

Above, the basic components and function of a cooling system according to the invention have been shown. There are however several modifications possible within the invention.

One such modification is to provide the deaeration tank 150 with a lid 155. The lid 155 is preferably a fairly simple lid, without the valves usually present in lids at cooling systems, and its only function is to enable filling of coolant when the cooling system is empty, e.g. after cooling system repair or when the cooling system is to be put into service. The lid 155 should preferably not be used to fill coolant in the system on a regular basis. Another modification is to provide the expansion tank 110 with a lid 115. This lid could be provided with valves, e.g. a vacuum valve allowing ambient air to enter the expansion tank in case the pressure in the expansion tank should be lower than the ambient pressure, and one safety valve releasing gas or coolant from the expansion tank if the pressure in the expansion tank would exceed e.g. 0.2 bars.

In another embodiment of the invention, the connection between the deaeration tank 150 and the expansion tank 110 opens below a level of a minimum water level; if the one-way valve 151 would cease to function, such a positioning of the connection would avoid air being sucked into the system during engine cool down.

The invention presents a cost efficient, uncomplicated and secure means to increase a coolant system pressure.

Dimensions

When used for cooling an internal combustion engine for a heavy duty vehicle, the cooling system according to the invention the deaeration tank 150 can have a volume of about 1-5 liter. For this application of the invention, the nozzle 174 can have a diameter of about 2-4 mm and the diameter of the neck 176 can be about 5-10 mm. The length of the mixing zone 175 can be about 4 to 10 times the diameter of the neck (176) and the mixing zone (175) can have a diameter increasing from the neck diameter to about 2 to 3 times the diameter of the neck 176. Normal operating temperature of the coolant for this application can be between about 80 and 1072 C.

The invention should not be considered as limited to the above-stated embodiments but can freely be modified within the scope of the following patent claims. For example, the deaeration tank 150 can be integral with the upper portion 121 of the radiator 120. The radiator 120 can be a cross flow type radiator with horizontal coolant pipes and vertical inlet and outlet tanks.

The invention claimed is:

1. A cooling system for an engine, the cooling system being divided into an inner circuit and an outer circuit, the inner circuit comprising a radiator, a cooling pump, a thermostat housing, an ejector pump, cooling channels arranged inside the engine and ducting connecting the components, the ejector pump being arranged to draw coolant from the outer system and deliver it to the inner system, wherein the outer system comprises an expansion tank, ducting interconnecting the expansion tank and the ejector pump and ducting interconnecting the inner circuit and the expansion tank, the system comprising a one-way valve placed in the ducting interconnecting the expansion tank and the inner circuit, wherein flow in the ducting interconnecting the expansion tank and the inner circuit is only permitted in a direction from the inner circuit to the expansion tank.

2. The cooling system of claim 1, wherein the one-way valve has an opening pressure of about 0.5 bar.

3. The cooling system of claim 1, further comprising a second one-way valve allowing a coolant flow from the expansion tank towards the ejector pump.

4. The cooling system of claim 1, wherein a deaeration tank serves as a junction for a ducting from an elevated position in the engine cooling system, a ducting from an inlet of the coolant pump, a ducting from a top portion of the radiator, and the ducting interconnecting the inner circuit and the expansion tank.

5. The cooling system of claim 4, wherein the deaeration tank has a volume of about 1-5 liter.

6. The cooling system as claimed in claim 1, wherein the ejector pump comprises an inlet chamber connected to an expansion tank, a nozzle opening in the inlet chamber for ejecting a flow of coolant towards a neck connecting downstream the inlet chamber, and a mixing zone having an increasing diameter in a flow direction of the coolant flow ejected from the nozzle.

7. The cooling system as claimed in claim 6, wherein the nozzle diameter is about 2-4 mm.

8. The cooling system as claimed in claim 6, wherein the neck diameter is about 5-10 mm.

9. The cooling system as claimed in claim 6, wherein the length of the mixing zone is about 4 to 10 times the diameter of the neck, and wherein the mixing zone has a diameter increasing from the neck diameter to about 2 to 3 times the diameter of the neck.

10. The cooling system of claim 2, further comprising a second one-way valve allowing a coolant flow from the expansion tank towards the ejector pump.

11. The cooling system of claim 2, wherein a deaeration tank serves as a junction for a ducting from an elevated position in the engine cooling system, a ducting from an inlet of the coolant pump, a ducting from a top portion of the radiator, and the ducting interconnecting the inner circuit and the expansion tank.

12. The cooling system of claim 11, wherein the deaeration tank has a volume of about 1-5 liter.

13. The cooling system as claimed in claim 2, wherein the ejector pump comprises an inlet chamber connected to an expansion tank, a nozzle opening in the inlet chamber for ejecting a flow of coolant towards a neck connecting downstream the inlet chamber, and a mixing zone having an increasing diameter in a flow direction of the coolant flow ejected from the nozzle.

14. The cooling system as claimed in claim 13, wherein the nozzle diameter is about 2-4 mm.

15. The cooling system as claimed in claim 13, wherein the neck diameter is about 5-10 mm.

16. The cooling system as claimed in claim 13, wherein the length of the mixing zone is about 4 to 10 times the diameter of the neck, and wherein the mixing zone has a diameter increasing from the neck diameter to about 2 to 3 times the diameter of the neck.

17. The cooling system as claimed in claim 16, wherein the neck diameter is about 5-10 mm.

18. The cooling system as claimed in claim 17, wherein the length of the mixing zone is about 4 to 10 times the diameter of the neck, and wherein the mixing zone has a diameter increasing from the neck diameter to about 2 to 3 times the diameter of the neck.

* * * * *